United States Patent [19]

Juillard

[11] Patent Number: 4,478,255

[45] Date of Patent: Oct. 23, 1984

[54] DEVICES FOR CUTTING PILE THREADS IN A LOOM FOR WEAVING VELVET IN A DOUBLE LAYER

[75] Inventor: Yves Juillard, Mulhouse, France

[73] Assignee: Societe Alsacienne de Construction de Materiel Textile, France

[21] Appl. No.: 493,979

[22] Filed: May 12, 1983

[30] Foreign Application Priority Data

May 26, 1982 [FR] France ..... 82 09115

[51] Int. Cl.[3] ..... D03D 39/18

[52] U.S. Cl. ..... 139/21; 139/291 C; 26/14

[58] Field of Search ..... 139/20, 21, 291 R, 291 C, 139/292; 26/13, 14; 156/254

[56] References Cited

U.S. PATENT DOCUMENTS 4,261,391 4/1981 Hommes et al. ..... 139/21

FOREIGN PATENT DOCUMENTS 767561 10/1971 Belgium ..... 139/291 C 2645321 4/1977 Fed. Rep. of Germany ... 139/291 C

*Primary Examiner*—Henry Jaudon

*Attorney, Agent, or Firm*—Cantor and Lessler

[57] ABSTRACT

Velvet which has been woven in a double layer passes between a table and a rule before the pile threads are cut by a knife in order to separate the two layers. The rule is suspended from a reinforcement bar by means of two anchoring points located at a distance from the ends of the rule, thus reducing the deflection of the rule and achieving enhanced uniformity in the height of velvet pile threads.

11 Claims, 6 Drawing Figures

DEVICES FOR CUTTING PILE THREADS IN A LOOM FOR WEAVING VELVET IN A DOUBLE LAYER

This invention relates to the textile industry and more particularly to velvet weaving looms. This fabric is woven in a double layer, that is to say by means of two superposed sheds in each of which are inserted weft threads, the pile threads being common to the two layers and separated by cutting them at the center.

The two layers of fabric can be wound together on the weaving loom, whereupon the roll of fabric is mounted on a special machine which unwinds the fabric while cutting the pile threads and therefore separating the two layers. It is a more common practice, however, to perform this operation on the weaving loom itself and to wind-on each of the two layers of cloth separately. In this case the two layers travel together, the bottom layer being applied against a guiding table and the top layer being maintained by a member which is parallel to the table and which will hereinafter be designated as a "rule". A suitable device of any known design cuts the pile threads opposite to the space provided between the table and the rule.

In order to ensure that the velvet has a uniform appearance, the pile threads must all have the same length and must therefore be cut in a direction which is strictly parallel to the ground cloth. This is possible only if the table and the rule are strictly parallel and if the knife works in a plane which is also parallel to the other two planes.

The table and the rule naturally have a length at least equal to that of the maximum width of the cloth, that is to say in practice between one and three meters, and these elements must be perfectly flat and strictly parallel. This involves the need for careful machining of opposite faces and for deflection which is reduced to the lowest possible degree, both on the table and on the rule.

The usual solution for reducing deflection of the table consists in exerting a thrust at the center of said table by means of a screw and locknut system.

Since the table is rigidly fixed to the frame of the weaving loom and is located beneath the fabric, this simple solution is convenient to use and proves satisfactory.

The same does not hold true, however, for the rule which is a part suspended above the fabric. Up to the present time, the rule has been fixed at both ends in a position which permits height adjustment by means of two vertical side members, especially vertical threaded rods mounted on the sides of the machine.

In order to reduce the deformation of the rule, it is possible at the time of machining to give the bearing face a shape which is reverse to the deflection and/or to apply prestress to said face by giving an angle of slope to the faces of the rule ends which are clamped on the threaded rods. But this does not permit adjustment as a function of the stresses applied to the rule by the fabric.

The solution which is the most commonly employed for producing adjustable action on the deflection of the rule consists in fixing a reinforcement bar above said rule within the vertical side members. Said bar is traversed at its mid-point by a screw which engages within an internally-threaded bore of the upper portion of the rule and which is fitted with a nut on each side of the reinforcement bar, thus making it possible to adjust and correct the deflection of the rule.

The disadvantage of this mode of adjustment, which has to be done again at each change in height of pile, is that it cannot readily be controlled. Although calibrated gage blocks can be inserted between the table and the rule outside the fabric, a measurement of the spacing within the zone of transfer of the fabric can be obtained only by cutting-out a window in said fabric in order to pass a gage block through the window.

The aim of the present invention is to overcome this disadvantage by dispensing with the need to correct deflection of the rule at the time of changes in height of pile. This deflection of the rule is reduced to a fairly low value in order to be compatible with a satisfactory quality of cut in all cases.

The invention is directed to a device for cutting pile threads in a loom for weaving velvet in a double layer. The device comprises a table for supporting the bottom layer; a rule for retaining the top layer; a rule-reinforcement bar fixed at both ends in a manner which permits height adjustment on two vertical side members rigidly fixed to the frame of the loom; and a pile cutting member which produces action opposite to the space formed between the table and the rule. In accordance with the invention, said rule is anchored solely to its reinforcement bar at two points which are distant from the ends of said rule, no means being provided at said ends for attaching the rule to the vertical side members aforesaid.

By virtue of this arrangement, the free length of the suspended rule is reduced, thereby reducing the deformation to a value which is compatible with satisfactory cutting of the pile threads. In addition, as will be apparent hereinafter, adjustment and checking of the space between the rule and the table as a function of the desired heights of pile threads are very greatly facilitated in comparison with known devices of the prior art.

Other features of the invention will be more apparent to those skilled in the art upon consideration of the following description and accompanying drawings, wherein.

Figure 1:
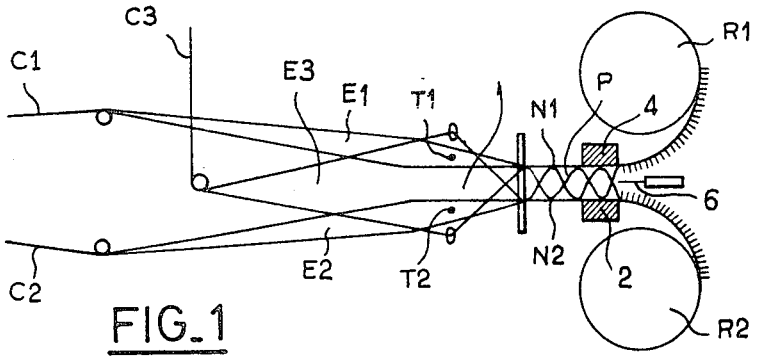
FIG. 1 is a schematic representation of a loom for weaving velvet in a double layer and of its pile-loop cutting device.
Figure 5:
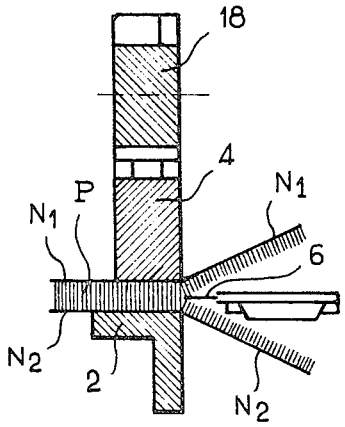
FIGS. 5 and 6 are respectively sectional views taken along lines A—A and B—B of FIG. 4.

In the schematic view of FIG. 1, there are shown the two layers of warp threads $C_1$–$C_2$ forming two superposed sheds E1–E2 which are joined to each other by a third layer C3 of pile threads P so as to form the shed E3 and in which are inserted the weft threads $T_1$–$T_2$ in order to form two fabric layers $N_1$–$N_2$ which are interconnected by the pile threads P. The bottom layer $N_2$ rests on the table 2, the top layer $N_1$ is retained by the rule 4, whereupon a cutting member or knife 6 cuts the pile threads opposite to the space formed between the rule and the table (as also shown in FIG. 5). The two separated velvet layers $N_1$–$N_2$ are then taken-up by the rollers $R_1$–$R_2$.

Figure 2:
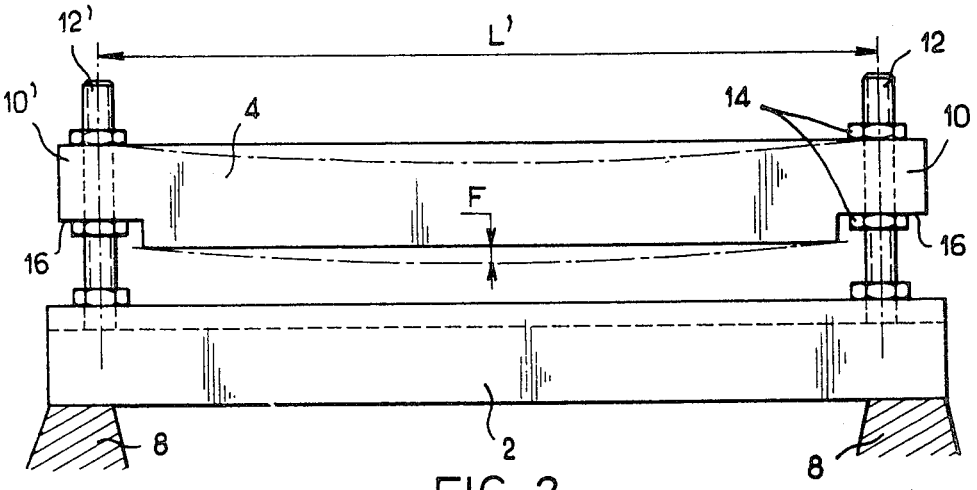
FIG. 2 is a view in elevation showing a known design of a cutting rule.

In FIG. 2, there is shown a known system of assembly in which the table 2 is secured to the frame 8 of the loom and in which the rule 4 is attached at its two ends 10, 10' to vertical side members constituted by threaded rods 12, 12', the lower ends of which are rigidly fixed to the frame 8 or to the table 2.

The rule can be locked on the threaded rods 12, 12' by means of nuts 14 in a position which can be adjusted for height, thus making it possible to adjust the spacing and parallel alignment of the rule with respect to the table.

In weaving looms of substantial width, however, the rule 4 must have a length which is appreciably greater than the width of the cloth, namely about two to three meters. By reason of its weight, said rule always has a natural deformation F after it has been mounted on the support rods 12, 12' as indicated in chain-dotted lines in FIG. 2. Such a deformation would therefore result in a non-constant height of the cut pile threads across the width of the cloth.

At the time of machining of the rule, arrangements can be made for giving it a profile such that the deflection is reduced to zero when the rule is suspended at both ends. A further alternative consists in adjusting the two faces 16 so that, when the nuts 14 are locked, the rule is stressed in such a manner as to nullify the deflection.

In both cases, however, the reaction of the fabric on the rule is not always the same as a function of the variations in texture or thickness of the fabric, with the result that the reaction of the deflection will not always be satisfactory. Moreover, by reason of the considerable span of the rule which is fixed at both ends, said rule is subjected to the vibrations of the machine and this may produce irregularities in cutting, especially at the time of startup and stopping of the loom.

Figure 3:
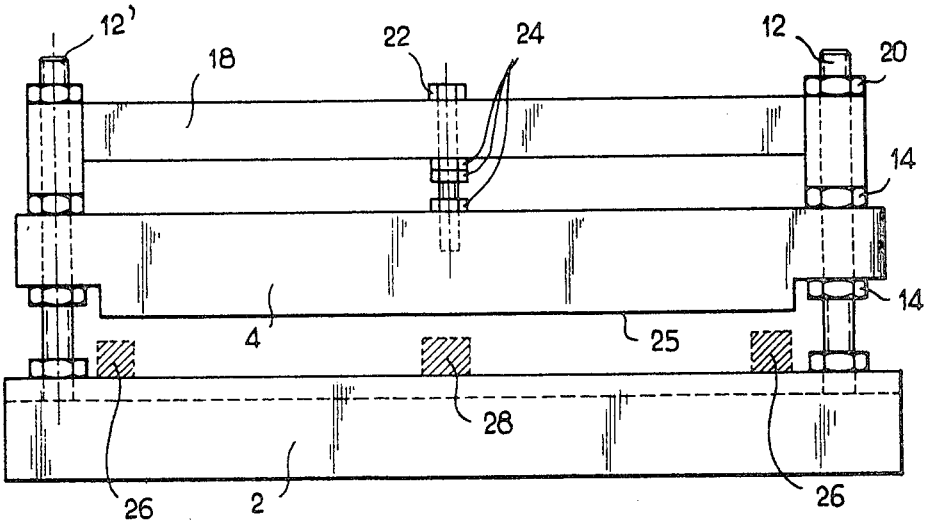
FIG. 3 is a view in elevation of the known and most widely employed design of a cutting rule with its reinforcement bar.

There is shown in FIG. 3 another known assembly for overcoming the disadvantages arising from deformation of the rule. This assembly is mainly identical with the assembly of FIG. 2 aside from the fact that it is provided in addition with a reinforcement bar 18 placed above the rule 4 and fixed at both ends on the vertical side members or threaded rods 12, 12' in the same manner as the rule itself and by means of locknuts 20.

At the center of the reinforcement bar 18, a screw 22 passes through said bar and is screwed into the rule 4, nuts and locknuts 24 are provided for locking the screw in the position which is chosen and in which the deflection of the face 25 of the rule is reduced to zero. By means of this system, parallel alignment of the two opposite faces of the table and of the rule can therefore be readily adjusted and checked by means of lateral gage blocks 26 and by modifying the position-settings of the nuts 14, 20 for fastening the rule and the reinforcement bar. It is also an easy matter to reduce the deflection of the rule to zero by means of the screw-and-nut system 22, 24, the operation being checked by means of a central gage block 28.

However, the checking operation just mentioned is possible only when the fabric is in position between the table and the rule unless a window is cut in the fabric for introducing the central gage block. Furthermore, correction of deflection has to be performed again by means of the screw 22 for each change in thickness of fabric and therefor for each displacement of the rule.

Figure 4:
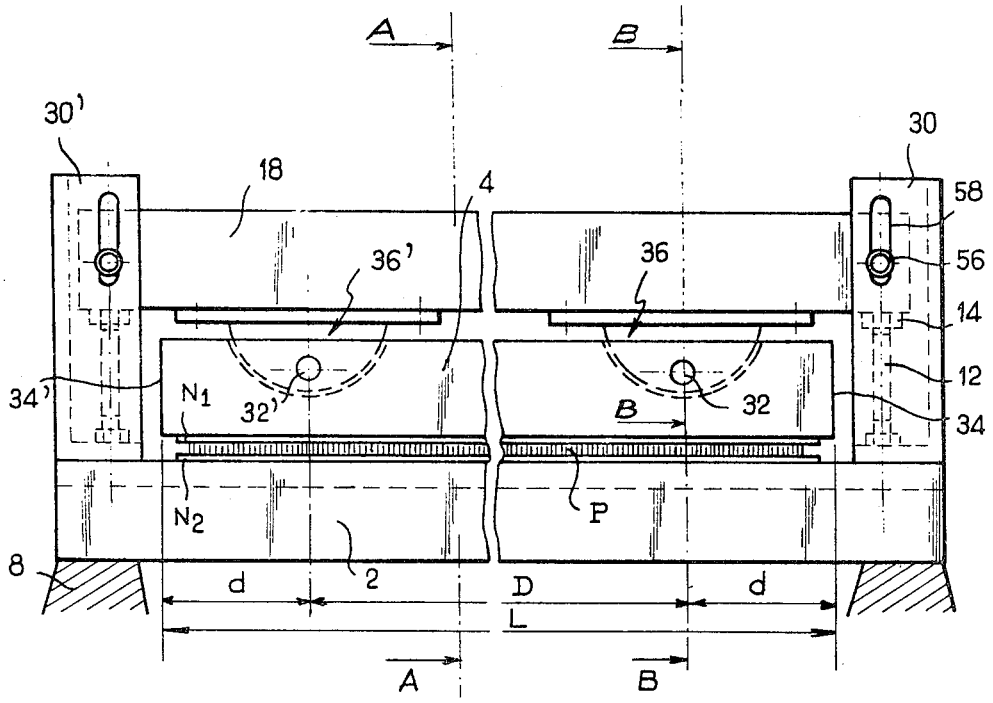
FIG. 4 is a view in elevation of the device in accordance with the invention.
Figure 6:
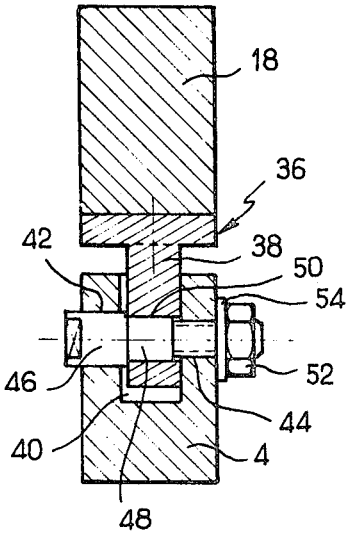

FIGS. 4, 5 and 6 illustrate the system of assembly of the rule in accordance with the invention.

The reinforcement bar 18 is supported at both ends by vertical side members 30, 30' which contain a system 12, 14 consisting of a threaded rod and nut which is similar to that described in connection with FIGS. 2 and 3.

The rule 4 is suspended beneath its reinforcement bar 18 and anchored to this latter only at two points 32, 32' located at a distance from its ends 34, 34'. In contrast to the practice adopted up to the present time, no means are provided at the ends 34, 34' of the rule 4 for securing said ends to the vertical uprights 30, 30'.

Anchoring of the rule 4 to the reinforcement bar 18 at the two anchoring points 32, 32' is carried out by means of two identical fastening elements 36, 36', only one of which will be described.

A lug 38 (shown in FIG. 6) is attached to the reinforcement bar 18 of the rule 4 by any known means. In a preferred embodiment of the invention (shown in FIG. 5), the rule 4 and its reinforcement bar 18 are constituted by two bars having the same cross-section and preferably formed of steel. However, for reasons related to ease of formation of a surface having minimum roughness, the rule 4 is sometimes made of cast-iron although the modulus of elasticity of cast-iron is lower than that of steel.

The lug 38 penetrates into a milled recess 40 of the upper portion of the rule and is attached to this latter without play by means of the system shown in FIG. 6. A bore 42 is provided in the rule 4 at the level of the milled portion 40. On one side of the milled recess 40, the bore 42 is internally threaded at 44 and is enlarged on the opposite side in order to accommodate the head 46 of a swivel-pin 48. That portion of the lug 38 which penetrates into the milled recess 40 is pierced by a hole 50 through which the swivel-pin 48 is passed. Said swivel-pin is then screwed into the internally-threaded threaded portion 44 and locks the lug 38 against the internal face of the recess 40. A locknut 52 and a washer 54 prevent unscrewing of the swivel-pin under the action of vibrations of the weaving loom.

In a preferred embodiment of the invention, the two anchoring points 32, 32' and therefore the two fastening elements 36, 36' are equidistant from the ends 34 of the rule 4 and so arranged that the interval D between said anchoring points is substantially equal to one-half and preferably three-fifths of the length of the rule. In other words, the anchoring points 32, 32' are located at a distance d from the ends 34, 34' of the rule which is approximately $\frac{1}{4}$ to 1/5 of the length of the rule.

This arrangement makes it possible to obtain a minimum deflection of the rule in that portion which is located between the two anchoring points. As can readily be understood, this deformation is consequently smaller than the amount of deformation which a rule undergoes when it is fixed at both ends in the conventional manner (as shown in FIGS. 2 and 3).

Accordingly, the amount of deformation is fairly small in order to be compatible with satisfactory cutting of the velvet pile threads and also remains constant irrespective of the distance between the rule and the table. It is therefore unnecessary to adjust the deformation when said distance varies as was the case with the known arrangement of FIG. 3.

It is worth of note that, in the device in accordance with the invention, the reinforcement bar 18 undergoes a certain amount of deflection by reason of its own weight and the weight of the rule supported by said bar. However, there is no need whatsoever to check or to correct this deformation since it has no effect on the position of the rule, this being due to the fact that the values of deformation measured at the level of the two anchoring points 32, 32' are identical by virtue of the symmetrical position of these two anchoring points.

Another point which should be noted is that, in accordance with the invention, the total length L of the rule (FIG. 4) is considerably less than the length L' between bearing points of known rules employed up to the present time (and shown in FIGS. 2 and 3), thereby producing a reduction in weight and therefore in deflection.

The adjustments to be performed on the cutting device in accordance with the invention are as follows:

The desired height of pile is indicated on the pile regulator of the weaving loom and the spacing of the rule 4 and of the table 2 is adjusted as a function of said height. After a predetermined length of velvet has been woven, the height of the pile threads is measured at different points of the width of the cloth. As a function of the results of said measurements, the spacing between table and rule is subjected to a fine adjustment by means of the screw and nut system 12–14 which displaces the reinforcement bar 18 in the desired direction. When the spacing has reached the correct value, the reinforcement bar 18 can be locked on the vertical side members 30, 30' by means of a screw 56 slidably mounted within an elongated slot 58 pierced in each vertical side member.

As can readily be understood, the invention is not limited in any sense to the embodiments hereinabove described by way of example and illustrated in the accompanying drawings. Depending on the applications which may be contemplated, a number of alternative embodiments within the capacity of those skilled in the art may accordingly be considered without thereby departing either from the scope or from the spirit of the invention.

What is claimed is:

1. A device for cutting pile threads in a loom for weaving velvet in a double layer and comprising a table for supporting the bottom layer, a rule for retaining the top layer, a rule-reinforcement bar fixed at both ends in a manner which permits height adjustment on two vertical side members rigidly fixed to the frame of the loom, and a pile cutting member which produces action opposite to the space formed between the table and the rule, wherein said rule is suspended from the reinforcement bar and is anchored solely to its reinforcement bar at two points which are distant from the ends of said rule, and wherein no means are provided for attaching the ends of said rule to the vertical side members aforesaid.

2. A device according to claim 1, wherein the two anchoring points are equidistant at a distance d from the ends of the rule.

3. A device according to claim 2, wherein the interval D between the two anchoring points is approximately $\frac{1}{2}$ to 3/5 of the length L of the rule.

4. A device according to claim 1, wherein the rule is anchored to its reinforcement bar at the two points aforesaid without play.

5. A device according to claim 4, wherein each anchoring point at which the rule is attached to its reinforcement bar is constituted by a lug rigidly fixed to said bar and secured within a milled recess of the rule.

6. A device according to claim 5, wherein the lug is rigidly fixed to the rule by means of a swivel-pin housed within a bore of the rule at the level of the milled recess.

7. A device according to claim 6, wherein the swivel-pin is locked in position by means of a locknut and a washer.

8. A device according to claim 6, wherein one of the portions of the bore formed in the rule is internally threaded.

9. A device according to claim 8, wherein the swivel-pin is locked in position by means of a locknut and a washer.

10. A device according to claim 8, wherein the threaded end of the swivel-pin is screwed into the internally-threaded portion of the rule.

11. A device according to claim 10, wherein the swivel-pin is locked in position by means of a locknut and a washer.

* * * * *